US010232425B2

(12) United States Patent
Del Fabro

(10) Patent No.: US 10,232,425 B2
(45) Date of Patent: Mar. 19, 2019

(54) APPARATUS FOR BENDING OBLONG METAL PRODUCTS, SUCH AS BARS, ROUND PIECES OR METAL WIRES, AND CORRESPONDING BENDING METHOD

(71) Applicant: A.C.M. SRL AUTOMATISMI COSTRUZIONI MECCANICHE, Reana del Rojale (IT)

(72) Inventor: Giorgio Del Fabro, Udine (IT)

(73) Assignee: A.C.M. SRL AUTOMATISMI CONTRUZIONI MECCANICHE, Reana del Rojale (IT)

( * ) Notice: Subject to any disclaimer, the term of this patent is extended or adjusted under 35 U.S.C. 154(b) by 0 days.

(21) Appl. No.: 15/029,601

(22) PCT Filed: Oct. 13, 2014

(86) PCT No.: PCT/IB2014/065253
§ 371 (c)(1),
(2) Date: Apr. 14, 2016

(87) PCT Pub. No.: WO2015/056144
PCT Pub. Date: Apr. 23, 2015

(65) Prior Publication Data

US 2016/0271672 A1 Sep. 22, 2016

(30) Foreign Application Priority Data

Oct. 14, 2013 (IT) ..... UD2013A0131

(51) Int. Cl.
*B21D 11/12* (2006.01)
*B21D 28/00* (2006.01)
*B21F 1/00* (2006.01)

(52) U.S. Cl.
CPC ..... *B21D 11/12* (2013.01); *B21D 28/00* (2013.01); *B21F 1/00* (2013.01)

(58) Field of Classification Search
CPC ..... B21D 7/022; B21D 7/702; B21D 7/04; B21D 11/12; B21D 9/05; B21D 9/07; B21D 9/073; B21D 9/076
See application file for complete search history.

(56) References Cited

U.S. PATENT DOCUMENTS

2007/0234775 A1 10/2007 Speck
2007/0256466 A1* 11/2007 Anagnostopoulos .. B21D 11/12 72/294
2012/0279274 A1 11/2012 Del Fabro

FOREIGN PATENT DOCUMENTS

DE 3416678 A1 * 1/1985 ..... B21D 11/12
EP 1 849 536 A1 10/2007

(Continued)

OTHER PUBLICATIONS

Machine translation of DE3416678A1, Dietrich, translated on May 9, 2018, pp. 1-14.*

(Continued)

*Primary Examiner* — Teresa M Ekiert
(74) *Attorney, Agent, or Firm* — Marshall, Gerstein & Borun LLP

(57) ABSTRACT

Apparatus for bending at least an oblong metal product comprising a feed channel to feed the metal product, and a bending unit positioned downstream of the feed channel and provided with at least a first contrast member and a first bending member configured to bend the metal product, on a first bending plane, around the first contrast member. The apparatus comprises a second contrast member provided in proximity to an exit end of the metal product from the feed channel and a second bending member mounted on the bending unit or in direct proximity to the bending unit, and selectively movable in a direction transverse to the first bending plane in order to bend the metal product around the (Continued)

second contrast member and on a second bending plane transverse to the first bending plane.

10 Claims, 6 Drawing Sheets

(56) References Cited

FOREIGN PATENT DOCUMENTS

| | | | |
|---|---|---|---|
| EP | 2 358 487 | A2 | 8/2011 |
| WO | WO-2011/064222 | A1 | 6/2011 |
| WO | WO-2012/160058 | A1 | 11/2012 |

OTHER PUBLICATIONS

International Search Report and Written Opinion for PCT/IB2014/065253, dated Jan. 13, 2015.

* cited by examiner

APPARATUS FOR BENDING OBLONG METAL PRODUCTS, SUCH AS BARS, ROUND PIECES OR METAL WIRES, AND CORRESPONDING BENDING METHOD

FIELD OF THE INVENTION

The present invention concerns an apparatus for bending oblong metal products, such as bars, round pieces, metal wires, either in the form of pre-cut bars or fed from a roll. In particular, the apparatus according to the present invention is applied to make stirrups, or other reinforcement elements for the building industry, with a three-dimensional conformation, that is, with at least one portion bent on a plane orthogonal, or in any case angled, with respect to the bending plane of the other portions.

The present invention also concerns the method for bending oblong metal products to obtain stirrups with a three-dimensional conformation.

BACKGROUND OF THE INVENTION

Apparatuses are known for bending metal products, also called stirrup-making machines, configured to bend a bar, a round piece, a metal wire, or other oblong metal product, in order to make stirrups for reinforcement cages.

The reinforcement stirrups can be two-dimensional stirrups, that is, whose sides lie on the same plane, or three-dimensional, in which at least one side lies on a different plane from that of the other sides. This angled side can have, for example, the function of a spacer or reference, with respect to another stirrup or to an existing structure.

Apparatuses are known for three-dimensional bending comprising a drawing unit, a shearing unit and a first bending unit that makes the bends on a first bending plane, in order to define the two-dimensional shape of the stirrup. This known apparatus also comprises a separate and subsequent second bending unit that makes the bends on a plane angled with respect to the first bending plane. The first bending unit consists of a bending support, or rotating mandrel provided centrally with a contrast pin and radially with a bending element.

The bending element can be rotated either clockwise or anti-clockwise, around the contrast pin, so that the segment of metal product that is interposed between the bending element and the contrast pin is bent around the latter.

In the same way, the second bending unit, distanced and autonomous with respect to the first bending unit, provides a contrast member disposed distanced from the feed plane of the metal product, in order to allow the latter to interpose itself between the contrast member and the feed plane.

The bending element is mobile on exit from the feed plane so as to intercept and plastically deform a segment of the metal product around the contrast member.

This type of known bending apparatus, providing two separate bending units, needs a double command and control line, both mechanical and electronic, to guarantee the management and operating coordination of the two bending units. This management requirement causes an increase in the times and costs of producing the apparatus, as well as time and maintenance costs of the latter. Moreover, having two separate bending units, the number of mechanical components that participate in the individual movements is also high. In the light of this, the known apparatus is bulkier than traditional two-dimensional machines and because of this, both the minimum dimension of the stirrup that can be obtained and also the precision of the bending can be compromised.

An apparatus is also known of the general type as described above for bending metal products with a two-dimensional and/or three-dimensional mode, described in the document WO2011/064222, in which the bending pin is also provided with a shaped portion that defines, in its turn, a contrast element for bending the metal product on a second bending plane, substantially transverse with respect to the first bending plane.

In particular, the shaped contrast portion is located above the feed plane of the metal product so as to define with it a hollow space through which the metal product is made to pass.

Immediately downstream of the first bending unit a bending member is provided which is selectively movable in a direction transverse to the feed plane of the metal product, so as to intercept and plastically deform the metal product and bend it on a plane substantially orthogonal to the first bending plane.

In particular, the movement of the bending member determines the bending of the metal product around the shaped contrast portion of the bending pin of the first bending unit.

Although it reduces the complexity of management and command of the different mobile components, this solution is also excessively bulky and has high production costs.

Moreover, the particular conformation of the shaped contrast portion of the bending pin makes the latter bulky and in some applications it interferes with the normal operations of two-dimensional bending.

One purpose of the present invention is to make an apparatus and perfect a method for bending metal products that allow to produce both two-dimensional stirrups and three-dimensional stirrups, that have limited times and costs, of production, management and coordination, and that provides simplified maintenance steps.

Another purpose of the present invention is to make an apparatus for bending metal products that allows to make both two-dimensional stirrups and three-dimensional stirrups, that has limited bulk when installed compared with similar known bending apparatuses and that guarantees an optimal bending precision.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, an apparatus for bending at least an oblong metal product comprises a feed channel to feed the metal product and a bending unit positioned downstream of the feed channel and provided with at least a first contrast member and a first bending member configured to bend the metal product, on a first bending plane, around the first contrast member.

According to one aspect of the present invention, the apparatus comprises a second contrast member provided in proximity to an exit end of the metal product from the feed channel and a second bending member mounted on the bending unit or in direct proximity to the bending unit, and selectively movable in a direction substantially transverse to the first bending plane in order to bend the metal product around the second contrast member and on a second bending plane substantially transverse to the first bending plane.

This configuration allows to obtain a very compact bending apparatus in which the members provided for bending on the second bending plane are substantially concentrated in proximity to the bending unit that makes the bend on the first bending plane. In this way it is possible to facilitate the management of the bending apparatus and obtain a greater control of the bending geometries that are achieved on each occasion.

According to one possible form of embodiment, it can be provided that the second bending member is associated with the first contrast member of the bending unit. This solution allows to further reduce the overall bulk of the apparatus, rendering it similar to that of an apparatus for making bends on a single plane.

The present invention also concerns a method for bending metal products with a bending apparatus as described above.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
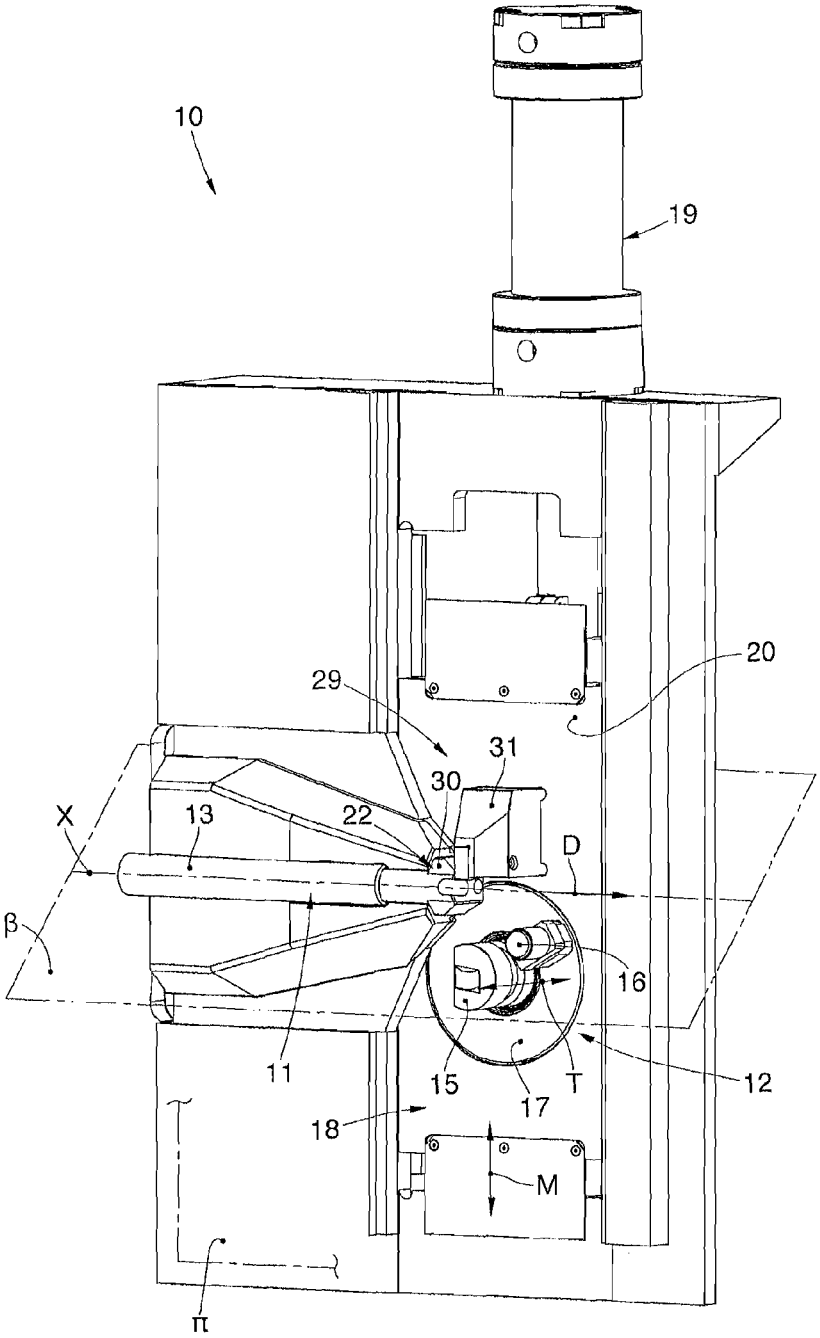
FIG. 1 is a perspective view of an apparatus for bending metal products according to a first form of embodiment.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF SOME FORMS OF EMBODIMENT

With reference to FIG. 1 a bending apparatus, according to one form of embodiment of the invention, is indicated in its entirety by the reference number 10 and is configured to bend oblong metal products P, such as bars, wire, round pieces or similar, in both two-dimensional mode and in three-dimensional mode.

The apparatus 10 comprises a drawing unit, of the known type and not shown in the drawings, configured to move the metal product P in a direction of feed D.

According to another aspect of the invention, the apparatus 10 comprises a feed channel 11 to feed the metal product P and a bending unit 12 positioned downstream of the feed channel 11.

The function of the feed channel 11 is to maintain the metal product P guided in its movement in the direction of feed D.

In possible formulations of the invention, the feed channel 11 develops linearly in a longitudinal direction X, during use substantially coinciding with the direction of feed D of the metal product P.

One possible solution provides that the feed channel 11 comprises a pipe, one or more guides, a rollerway with rolls possibly mounted with different orientations, or possible combinations thereof.

According to possible formulations of the present invention it can be provided that the drawing unit is mounted in an intermediate position along the longitudinal extension of the feed channel 11, although an installation upstream of the latter is not excluded.

Figure 2:
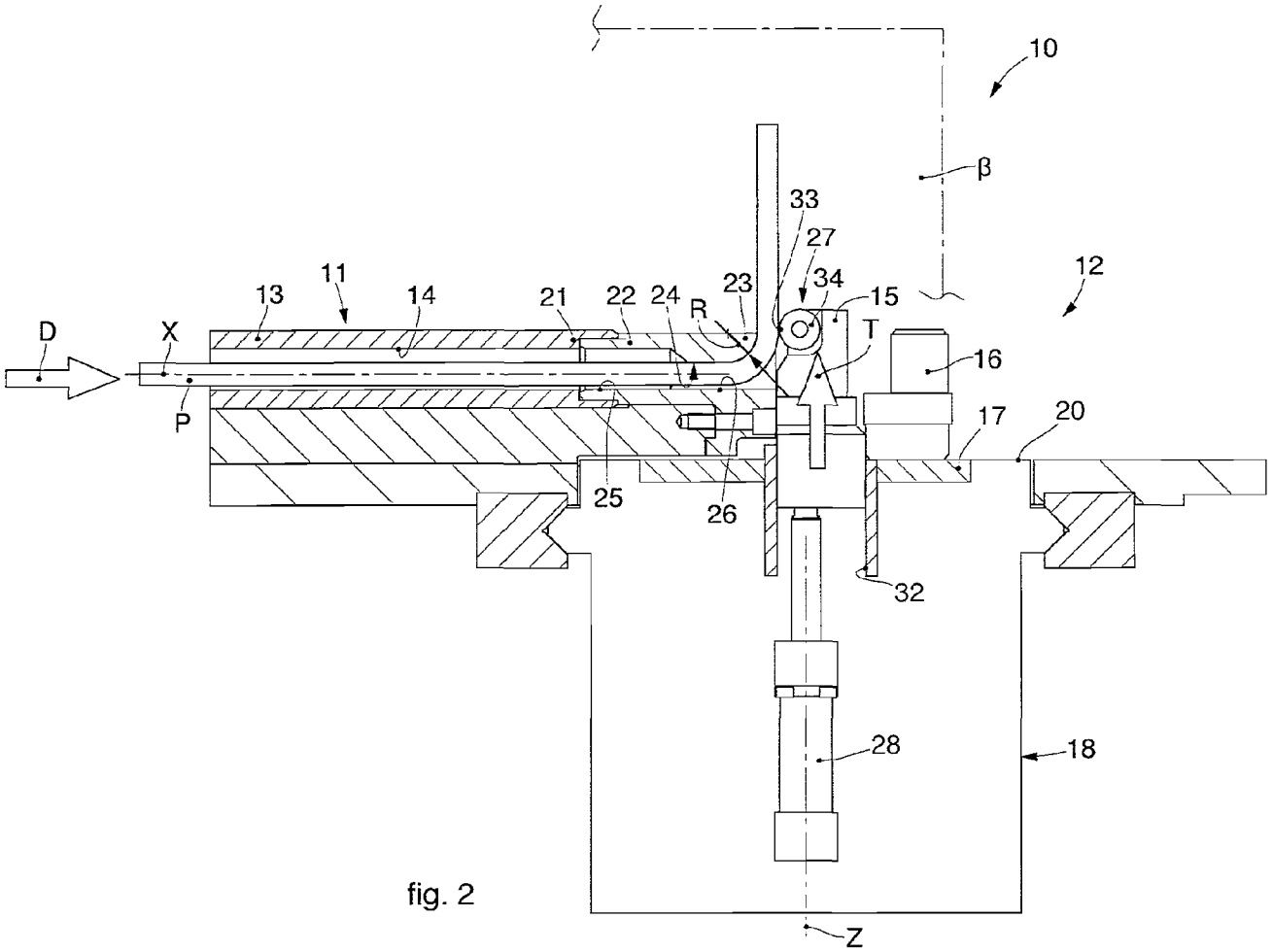
FIG. 2 is a section view of the bending apparatus according to possible forms of embodiment.

In the form of embodiment shown in FIG. 2, the feed channel 11 comprises a tubular element 13 provided with a longitudinal cavity 14 through which the metal product P is made to pass and is guided.

According to one formulation of the invention, the bending unit 12 comprises at least a first contrast member 15 and first bending member 16 configured to bend the metal product P around the first contrast member 15 and on a first bending plane $\pi$. The first contrast member 15 can comprise one or more pins or cylindrical bodies.

In possible alternative solutions, the first contrast member 15 can comprise two elongated pins defining a central passage channel of the metal product.

In a possible formulation of the invention, the first bending member 16 can be installed on a disc, or mandrel 17, selectively rotatable around an axis of rotation Z located substantially orthogonal to the first bending plane $\pi$. To this purpose a motor member, not shown in the drawings, can be connected to the mandrel 17, configured to allow the rotation of the mandrel 17 and the activation of the first bending member 16.

The mandrel 17 can have a flat development and can in practice define the first bending plane $\pi$.

The first contrast member 15, at least during the bending operations, is kept stationary and the metal product P is bent around it.

According to a possible solution, see FIGS. 1 and 2 for example, the bending unit 12 comprises a support frame 18 on which at least the first contrast member 15 and the first bending member 16 are mounted.

According to possible solutions, movement members 19 can be connected to the support frame 18, provided to move at least the first contrast member 15 and the first bending member 16 on the first bending plane $\pi$ and in a direction of movement M transverse to the direction of feed D of the metal product P.

The support frame 18 in its turn can also comprise a support plane 20 located, during normal use, substantially parallel and coincident with the first bending plane $\pi$.

The support plane 20 can be selectively translated along the direction of movement M by the action of the movement members 19.

In correspondence to the exit of the metal product P, the feed channel 11 is provided with an end 21.

According to one solution of the invention, the end 21 of the feed channel 11 is provided with, or defines, a second contrast member 22, shaped and configured to supply a contrasting action to the bending of the metal product P on a second bending plane $\beta$, located substantially transverse to the first bending plane $\pi$.

In possible implementations of the present invention, the second bending plane $\beta$ is disposed substantially orthogonal with respect to the first bending plane $\pi$. It can also be provided that the longitudinal direction X lies on the intersection between the first π and the second bending plane β.

According to a possible formulation of the present invention, shown for example in FIGS. 1 and 2, the second contrast member 22 is a separate component of the feed channel 11 and mounted in correspondence or in strict proximity to the end 21.

According to a possible variant, the second contrast member 22 is made in a single body with the feed channel 11.

The second contrast member 22 is sized and made of materials suitable to resist the bending stresses to which it can be subjected during use.

According to a possible formulation of the invention, see FIG. 2 for example, the second contrast member 22 can comprise a conveying channel 24 disposed aligned to the feed channel 11 and configured to guide the movement of the metal product P toward the bending unit 12.

According to possible formulations of the present invention, the conveying channel 24 is provided with an introduction portion 25 with a cross section size substantially equal to that of the feed channel 11.

According to other forms of embodiment, downstream of the introduction portion 25 the conveying channel 24 is provided with a guide portion 26, provided to guide the movement of the metal product P. The guide portion 26 can have a reduced section size with respect to that of the introduction portion 25, so as to suitably control the movement of the metal product P.

Between the introduction portion 25 and the guide portion 26 a rounded portion can be interposed, configured to prevent the occurrence of blockages of the metal product P.

According to a possible formulation of the present invention, the conveying channel 24 of the second contrast member 22 is provided, in its terminal end, with at least a contrast portion 23 against which, during use, the metal product P is bent.

The contrast portion 23 can have a rounded configuration, according to a radius of curvature R. The radius can have different values, for example depending on the diameter of the metal product and/or the shape of the stirrup to be made.

According to an alternative form of embodiment of the present invention, shown for example in FIGS. 1 and 2, between the feed channel 11 and the bending unit 12 a shearing unit 29 can be interposed, shears for example, configured to shear the metal product P in transit.

According to possible formulations of the present invention, the second contrast member 22 defines at least a part of the shearing unit 29.

With reference to FIG. 1, it can be provided, for example, that the second contrast member 22 defines the fixed part of the shearing unit 29 even if it is not excluded that it can define the mobile part.

According to one form of embodiment, shown for example in FIG. 1, the shearing unit 29 comprises a fixed part 30 mounted solid with the feed channel 11 and a mobile part 31 selectively movable toward the fixed part 30, for example in a direction transverse to the direction of feed D, to shear the metal product P. In this case it can be provided that the terminal part of the second contrast member 22 in turn defines the cutting blade of the fixed part 30 of the shearing unit 29.

According to possible forms of embodiment, possibly combinable with the forms of embodiment described above, the mobile part 31 of the shearing unit 29 is mounted on the support plane 20 and is activated by actuating the movement members 19.

However it is not excluded that the shearing unit 29 can be applied in an intermediate position of the feed channel 11 or in proximity to the end 21 of the latter.

According to one form of embodiment of the invention, the apparatus 10 comprises a second bending member 27 mounted on the bending unit 12, or in direct proximity to the bending unit 12, and selectively movable in a transverse direction T with respect to the first bending plane π. In particular, the second bending member 27 is configured to bend the metal product P around the second contrast member 22 and on the second bending plane β.

According to a possible form of embodiment of the invention, the second bending member 27 is associated, or directly or indirectly connected to an actuator 28 which is configured to move the second bending member 27 in the transverse direction T.

The actuator 28 can comprise at least one of either an electric actuator, a hydraulic actuator, a rack, a worm screw, or similar or comparable members suitable to the purpose.

According to possible forms of embodiment, the actuator 28 can be attached to the support frame 18 of the bending unit 12.

According to a first formulation of the present invention, for example shown in FIGS. 1 and 2, the second bending member 27 is associated with the first contrast member 15 of the bending unit 12.

In particular, it can be provided that the second bending member 27 is made in a single body with the first contrast member 15 or, in other forms of embodiment, that the second bending member 27 is a separate component and subsequently connected to the first contrast member 15. This latter solution allows to suitably size the different components also in relation to the specific mechanical stresses to which they will be subjected during use.

In a possible implementation of the invention, the actuator 28 is connected to the first contrast member 15 in order to move the second bending member 27 in the transverse direction T.

In particular, with reference to FIG. 2, it is provided that the actuator 28 determines the sliding of the first contrast member 15 through a guide seating 32 made in the mandrel 17.

Indeed, with this form of embodiment the first contrast member 15 and the second bending member 27 substantially coincide in the same component, or are substantially integrated with respect to each other. This solution allows to simplify the complexity of the apparatus 10 since, with the necessary modifications, it is possible to use known components already present in the apparatus 10 to carry out functions not previously envisaged. Moreover, this solution allows to reduce and contain the overall bulk of the apparatus 10.

The actuator 28 can be configured to take the first bending member 15 and the second bending member 16 into a non-operating condition, for example retracted with respect to the support plane 20.

The actuator 28 can also be provided to move the first contrast member 15 and the first bending member 16 simultaneously.

According to the form of embodiment shown in FIG. 2, the second bending member 27 can comprise a contact portion 33 with the metal product P, which is rounded convex in order to reduce the friction with the latter when it is bent around the second contrast member 22.

Possible implementations can provide that the second bending member 27 comprises a cylindrical body 34 mounted idle on the first contrast member 15 and in which its circumferential surface defines the contact portion 33 with the metal product P.

In possible solutions, not shown in the drawings, it can be provided that the circumferential surface of the cylindrical body 34 is provided with a circumferential groove to receive and guide the metal product P at least during bending on the second bending plane β.

As shown in FIG. 2, it can be provided that the second contrast member 22 extends partially overlapping above the bending unit 12, so as to dispose itself with its terminal end substantially flush with the first contrast member 15.

This solution not only does not conflict with the need to bend the metal product P on the first bending plane π, but also allows to dispose the second contrast member 22, during use, substantially adjacent to the second bending member 27. This allows a correct execution of the bends also on the second bending plane β.

Figure 3:
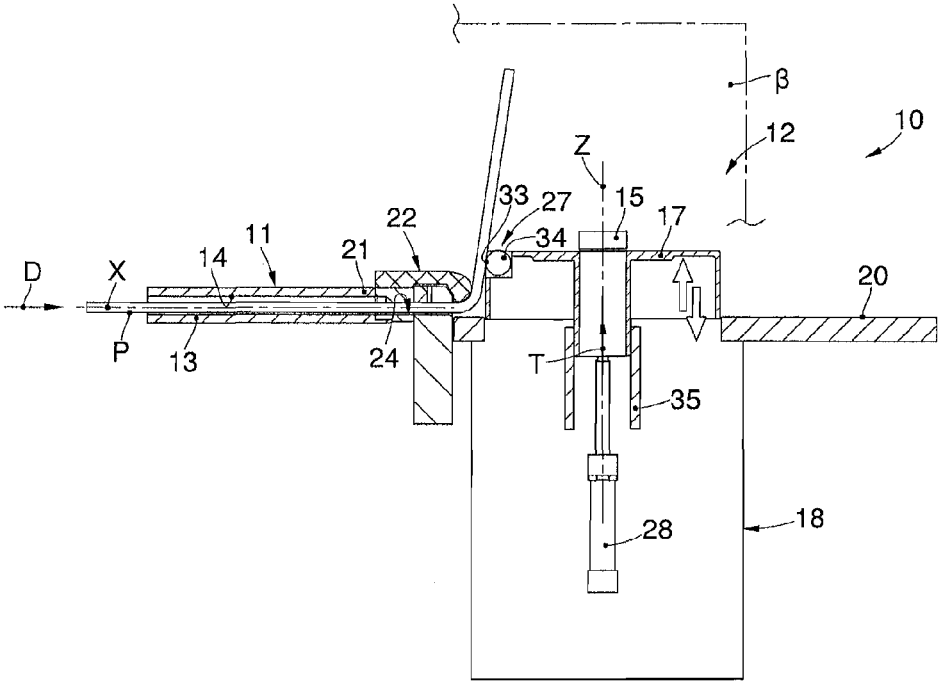
FIG. 3 is a section view of the bending apparatus according to another form of embodiment.
Figure 4:
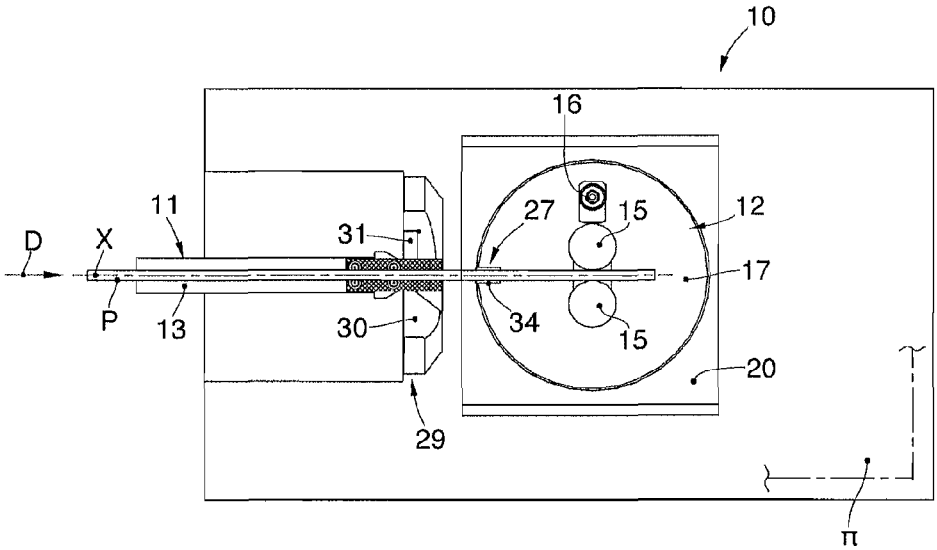
FIG. 4 is a plan view of FIG. 3.

According to a second formulation of the present invention, shown for example in FIGS. 3 and 4, the second bending member 27 is associated to the mandrel 17.

In this form of embodiment, it can be provided that the actuator 28 is connected to the mandrel 17 and is configured to move the latter and the second bending member 27 in the transverse direction T.

According to some forms of embodiment of the present invention, the second bending member 27 is mounted on a perimeter edge of the mandrel 17 and can be selectively positioned, for example by means of the motor member that drives the latter, in order to be disposed on each occasion substantially facing the second contrast member 22.

It can be provided that the support frame 18 is provided with guide members 35 provided with guide seatings oriented in the transverse direction T, in order to guide the movement of the mandrel 17.

During the execution of the bends on the first bending plane π, the mandrel 17 is disposed substantially aligned to the support plane 20; when it becomes necessary to make bends on the second bending plane β, it is taken into a condition protruding from the support plane 20, generating a thrust, in this case toward the outside of the support plane 20, on the metal product P disposed there.

According to a possible form of embodiment, the second bending member 27 can be made in a single body with the mandrel 17, even though it is not excluded that in other forms of embodiment, shown for example in FIGS. 3 and 4, the second bending member 27 is a separate component and subsequently connected to the mandrel 17. This allows to make a component which is suitably sized to support stresses to which it will be subjected during use.

As shown in FIGS. 3 and 4, the second bending member 27 comprises a cylindrical body 34, similar to that described above with reference to FIG. 2 and with the same functions, mounted idle on the mandrel 17.

According to the forms of embodiment of FIGS. 3 and 4, it can be provided that the second contrast member 22 is mounted in correspondence to the terminal end of the feed channel 11 so as to be disposed substantially flush with the perimeter edge of the mandrel 17 and therefore with the second bending member 27.

Figure 5:
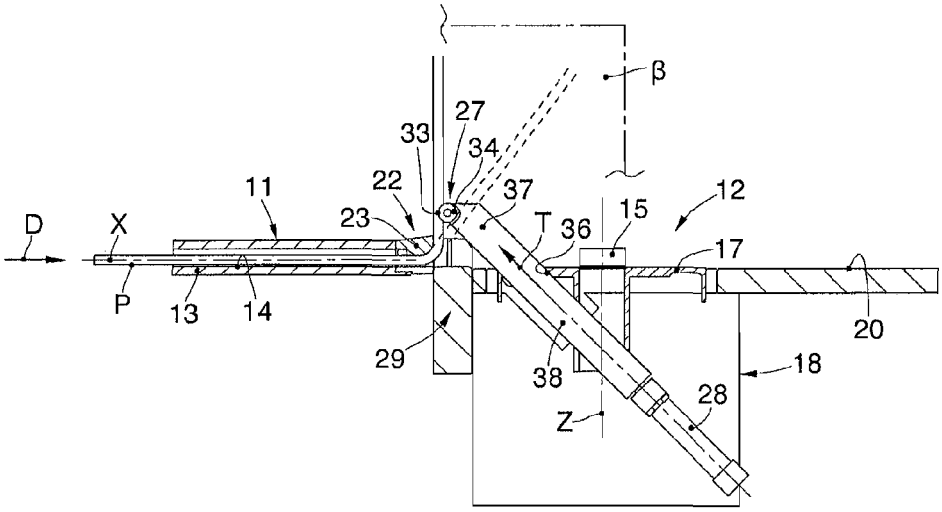
FIG. 5 is a section view of the bending apparatus according to another form of embodiment.
Figure 6:
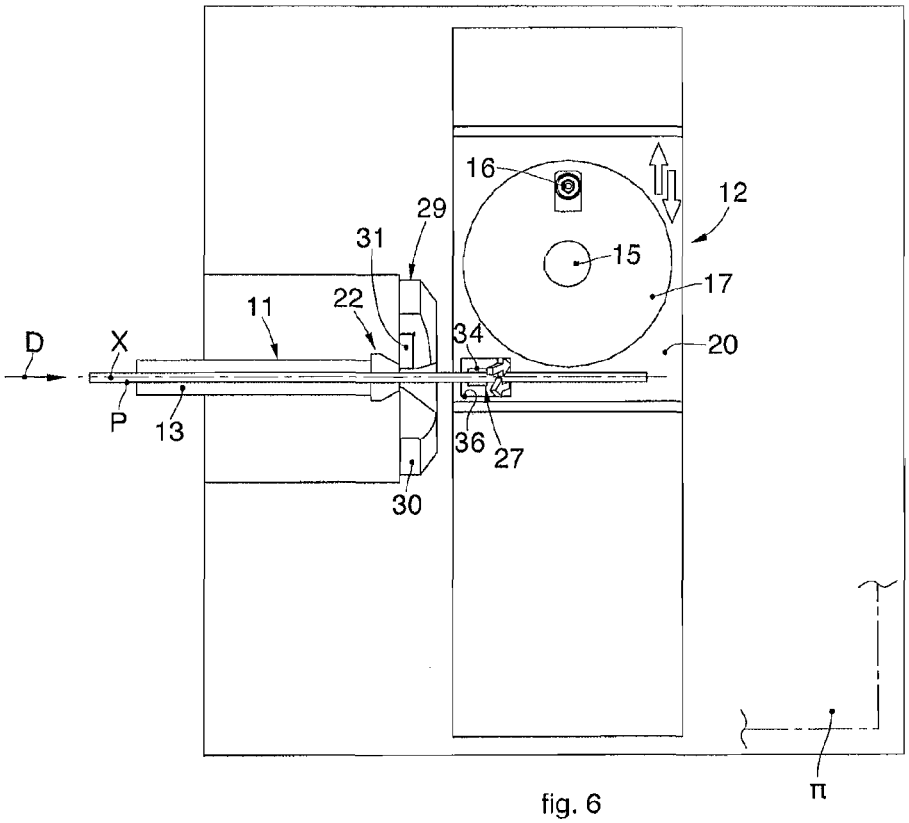
FIG. 6 is a plan view of FIG. 5.

According to another formulation of the present invention, shown for example in FIGS. 5 and 6, it is provided that the second bending member 27 is mounted in direct proximity to the bending unit 12.

The second bending member 27 can assume a first operating condition, retracted with respect to the support plane 20, and a second operating condition, protruding from the support plane 20.

The second bending member 27 can be mounted directly on a terminal actuation end 37 of the actuator 28.

As shown in FIG. 5, the second bending member 27 can be mounted at a first end of a tubular extension element 38, fixed to a second end of the actuator 28.

With reference to the form of embodiment shown in FIG. 5, the second bending member 27 is mounted on the support frame 18 adjacent to the mandrel 17.

In particular, a possible form of embodiment, shown for example in FIG. 6, provides that the second bending member 27 is mounted so as to stay, at least in its inactive condition, comprised in the plan bulk defined by the bending unit 12. According to some forms of embodiment, the plan bulk of the bending unit 12 can be defined by the surface extension of the support plane 20 on which the mandrel 17 is mounted.

In particular, the entity of movement of the second bending member 27 allows to determine the entity of bending of the metal product P around the second contrast member 22 and on the second bending plane β.

According to some forms of embodiment, an example of which is shown in FIG. 5, the support plane 20 on which the mandrel 17 is mounted is provided with a passage seating 36 through which the second bending member 27 is made to pass.

The second bending member 27 can be moved in the transverse direction T that is disposed inclined toward the feed channel 11 and with respect to the first bending plane π at an angle of inclination α. The angle of inclination α can be comprised between 25° and 65°, preferably between 30° and 60°, even more preferably between about 40° and 50°.

To this purpose it is provided that the actuator 28 is mounted on the support frame 18 inclined, according to said angle of inclination α, toward the feed channel 11.

With this configuration, the second bending member 27 can make bends with angles even bigger than 90° with a single exit and re-entry cycle.

With reference to FIGS. 7-12 a work sequence of a metal product P is shown for the execution of bends both on the first bending plane π and on the second bending plane β.

Figure 7:
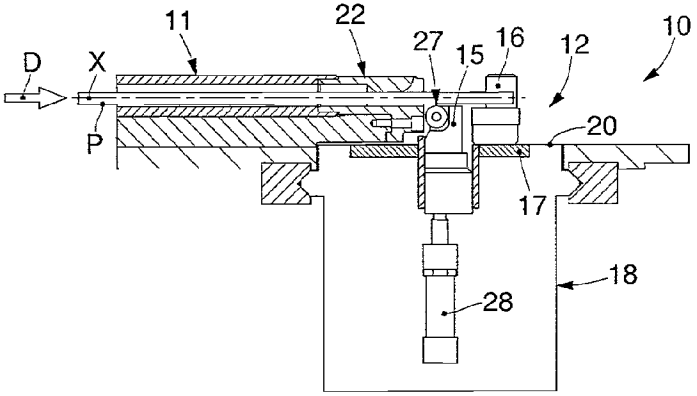

In particular, with reference to FIG. 7 it is provided to feed the metal product P in the direction of feed D and toward the bending unit 12. The metal product P is disposed so as to protrude from the feed channel 11 and from the second contrast member 22 with its first segment 41.

In this operating condition, the first contrast member 15 and the second bending member 27 associated with it are disposed below the metal product P so as not to interfere with the latter during the movements.

Figure 8:
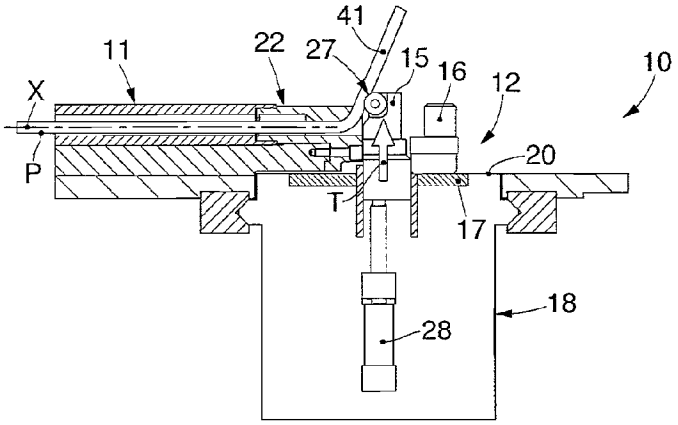
FIGS. 7-12 are schematic representations of a bending sequence of a metal product.

Subsequently, see FIG. 8, the actuation of the actuator 28 is commanded to move the second bending member 27 in the transverse direction T so as to protrude from the support plane 20.

During the movement of the second bending member 27, the latter enters into contact with the metal product P and, by a thrust action, bends the first segment 41 around the second contrast member 22. With this operation, the metal product P can be bent directly by about 90'° or, as shown in FIG. 8, bent by an angle less than 90°.

Figure 9:
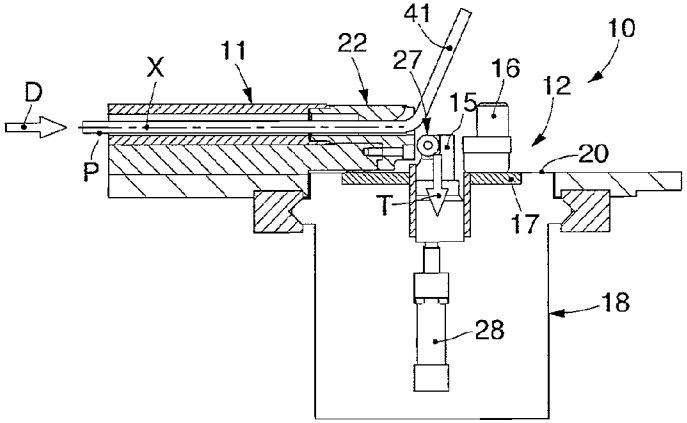
Figure 11:
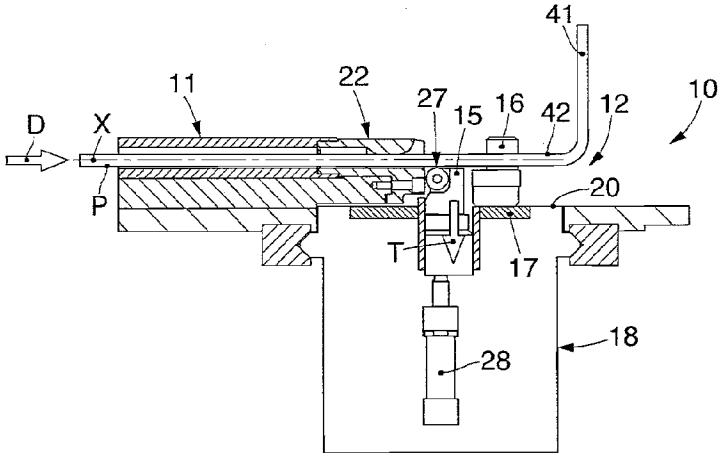
Figure 10:
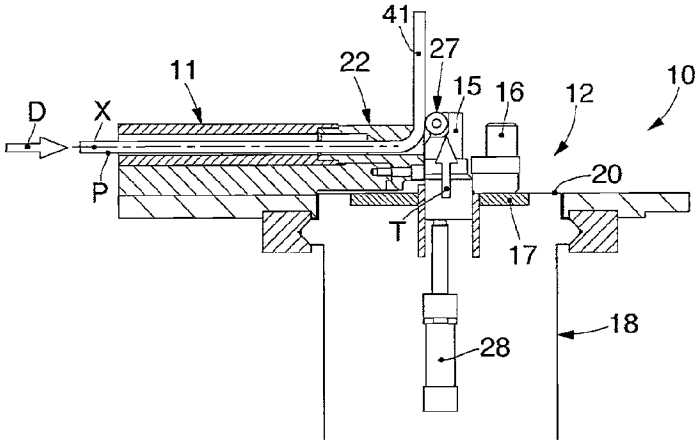
Figure 12:
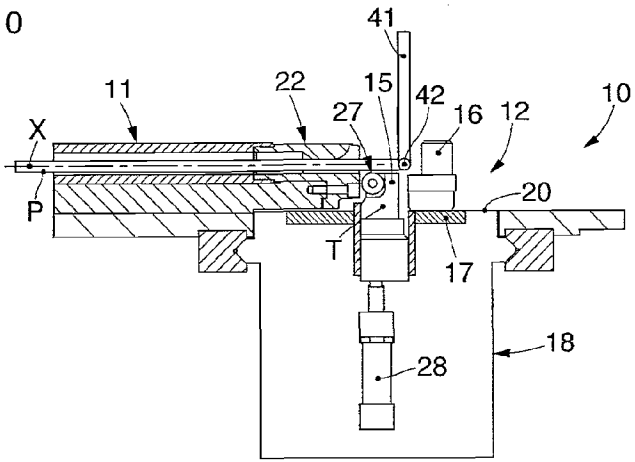

In the latter case it can be provided that the bending of the first segment 41 of the metal product P is subsequently completed as shown in FIGS. 9 and 10.

In particular, as can be seen in FIG. 9, the second bending member 27 is taken to a condition of non-interference with the feed of the metal product P in the direction of feed D.

In this condition, the metal product P is made to advance toward the bending unit 12 by a determinate length. Subsequently, as shown in FIG. 10, the second bending member 27 is activated again to translate it in the transverse direction T and to complete the execution of the bend.

According to a possible variant, alternative to the operations shown in FIGS. 9 and 10, it can be provided that, once a first bending of the first segment 41 has been executed, maintaining the second bending member 27 protruding with respect to the first bending plane π, the metal product P is made to advance in the direction of feed D. In practice, the first bent segment 41 is pressed against the second contrast member 22 in order to complete the bending of the first segment 41 to make a bending angle of about 90°. An applicational variant, combinable with the forms of embodiment described here, provides that the two movements in the direction of feed D and in the transverse direction T can be simultaneous.

The metal product P can also be bent on the first bending plane π. In this case the metal product P is moved in the direction of feed D making a second segment 42 of the metal product P protrude from the feed channel 11 toward the bending unit 12.

Subsequently, the bending unit 12 is activated in order to command the activation of the first bending member 16 and to bend the second segment 42 of the metal product P around the first contrast member 15.

It is clear that modifications and/or additions of parts may be made to the apparatus for bending oblong metal products and the corresponding bending method as described heretofore, without departing from the field and scope of the present invention. It is also clear that, although the present invention has been described with reference to some specific examples, a person of skill in the art shall certainly be able to achieve many other equivalent forms of apparatus 10 for bending oblong metal products P and the corresponding bending method, having the characteristics as set forth in the claims and hence all coming within the field of protection defined thereby.

The invention claimed is:

1. Apparatus for bending at least an oblong metal product, comprising:

a feed channel to feed said metal product;

a bending unit positioned downstream of the feed channel and provided with at least a first contrast member and a first bending member configured to bend the metal product, on a first bending plane, around said first contrast member;

a second contrast member provided in proximity to an exit end of said metal product from said feed channel; and a second bending member mounted on said bending unit or in direct proximity to said bending unit, and selectively movable in a direction transverse to the first bending plane in order to bend said metal product around said second contrast member and on a second bending plane transverse to said first bending plane, wherein between said feed channel and said bending unit a shearing unit is interposed, configured to shear said metal product, and in that said second contrast member defines at least one of either a fixed part and/or a mobile part of said shearing unit.

2. Apparatus as in claim 1, wherein said second bending member is associated with an actuator configured to move said second bending member in said transverse direction.

3. Apparatus as in claim 2 wherein said actuator is connected to said first contrast member and is configured to move both said first contrast member and also said second bending member in said transverse direction.

4. Apparatus as in claim 2 wherein said first bending member is installed on a mandrel, selectively rotatable, to determine the activation of said first bending member, and in that said second bending member is associated with said mandrel, and wherein said actuator is connected to said mandrel and is configured to move the latter and said second bending member in said transverse direction.

5. Apparatus as in claim 2, wherein said second bending member is disposed in proximity to said bending unit and is mounted directly on a terminal end of said actuator.

6. Apparatus as in claim 1, wherein the second contrast member is at least partially defined by the exit end of the feed channel and is shaped to supply a contrasting action to bend the metal product on the second bending plane.

7. Apparatus as in claim 1, wherein said second bending member is associated with said first contrast member of the bending unit.

8. Apparatus as in claim 1, wherein said second contrast member extends longitudinally, partly overlapping above said bending unit, and is disposed with its terminal end substantially flush with said first contrast member.

9. Apparatus as in claim 1, wherein said first bending member is installed on a mandrel, selectively rotatable, to determine the activation of said first bending member, and in that said second bending member is associated with said mandrel.

10. Apparatus as in claim 9 wherein said second bending member is mounted on a perimeter edge of said mandrel.

* * * * *